US005585832A

United States Patent [19]

Orimoto et al.

[11] Patent Number: 5,585,832

[45] Date of Patent: Dec. 17, 1996

[54] CONTROL DEVICE FOR TEMPERATURE OF ULTRAVIOLET LAMP FOR COLOR DIRECT THERMAL PRINTER

[75] Inventors: Masaaki Orimoto; Nobuo Katsuma; Satoshi Ueda; Hiroyuki Matsukawa, all of Saitama, Japan

[73] Assignee: Fuji Photo Film Co., Ltd., Kanagawa, Japan

[21] Appl. No.: 178,828

[22] Filed: Jan. 7, 1994

[30] Foreign Application Priority Data

Jan. 7, 1993 [JP] Japan ..... 5-001374
Dec. 3, 1993 [JP] Japan ..... 5-304379

[51] Int. Cl.[6] ..... B41J 2/315; B41J 2/32

[52] U.S. Cl. ..... 347/175; 362/294

[58] Field of Search ..... 347/175, 174, 347/172, 223; 400/120.03, 120.02, 700; 362/255, 294, 373, 345, 802, 276, 296, 96; 355/208, 285, 288; 361/694, 695, 690, 688, 689

[56] References Cited

U.S. PATENT DOCUMENTS 4,734,704 3/1988 Mizutani et al. ..... 347/175
4,835,667 5/1989 Wolfe ..... 362/802
5,410,335 4/1995 Sawano et al. ..... 347/175

FOREIGN PATENT DOCUMENTS 0409757 1/1991 European Pat. Off. ..... 362/294
0443784 8/1991 European Pat. Off. ..... 362/294
3923108 2/1990 Germany ..... 362/294
6333321 9/1983 Japan .
4308788 10/1992 Japan .
6-215615 8/1994 Japan ..... 362/294

*Primary Examiner*—Huan H. Tran

[57] ABSTRACT

A color direct thermal printer has a yellow fixing ultraviolet lamp and a magenta fixing ultraviolet lamp, in order to fix the coloring of color thermosensitive recording material. Behind the yellow and magenta fixing ultraviolet lamps is disposed a reflector, which has portions contacting the yellow and magenta fixing ultraviolet lamps for receiving heat from the yellow and magenta fixing ultraviolet lamps. Outside the reflector, a temperature sensor is mounted which measures tube temperature of the yellow and magenta fixing ultraviolet lamps through the reflector. When the measured temperature is greater than 40° C., the fan is driven and sends air to the yellow and magenta fixing ultraviolet lamps. If the measured temperature is less than 30° C. at the time of operating the starting key, a start of the printing operation is delayed. In the delay, the yellow and magenta fixing ultraviolet lamps are actuated and the tube temperature is raised.

20 Claims, 8 Drawing Sheets

CONTROL DEVICE FOR TEMPERATURE OF ULTRAVIOLET LAMP FOR COLOR DIRECT THERMAL PRINTER

BACKGROUND OF THE INVENTION

1. Field of the Invention

The present invention relates to a control device for temperature of a lamp, and a color direct thermal printer in use with the control device. More particularly, the present invention relates to a lamp temperature control device capable of maintaining intensity of radiation of the lamp while adjusting tube temperature of the lamp.

2. Description Related to the Related Art

In a color direct thermal printer, a color thermosensitive recording material is used, which is constituted of a support, a cyan coloring layer, a magenta coloring layer, and a yellow coloring layer, formed in the layered structure in the order listed, to print a full-color image directly according to the thermal printing, as disclosed, for example, in U.S. Pat. No. 4,734,704 (corresponding to JP-A 61-213169). In recording images by use of the color recording material, the uppermost layer at the obverse side is first subjected to recording. The thermal recording is performed in the order to the undermost layer at the reverse side. The coloring of a layer, of which the recording is finished, is fixed by application of ultraviolet radiation in a wavelength range appropriate for each layer, before the next underlying layer is subjected to the recording. This is for the purpose of invalidating the coloring ability and preventing the colored overlying layer from being colored again in an accidental manner.

To emanate ultraviolet radiation for fixation of the coloring, an ultraviolet lamp in a tubular shape is used. The lamp emanates radiation not only to the front but also to the rear. A reflector is disposed behind the lamp and apart therefrom, and is used for reflecting the rear radiation in order to utilize the performance of the lamp fully. The ultraviolet lamp, as disclosed in JP-Y 63-33321, has a radiating intensity which is changeable according to the temperature of a lamp tube. The tube temperature is different between a plurality of positions along the lamp. The electric current discharged in the lamp is conditioned by the lowest temperature among the tube positions. It follows that the overall radiating intensity of the lamp depends upon the lowest temperature. In general, the lamp has such characteristics that, if the tube temperature is lower, then the radiating intensity is lower; if the tube temperature rises, then the radiating intensity is raised; and when the tube temperature is extremely high, then the radiating intensity decreases. In view of stabilizing the fixation of the coloring, it is necessary to keep constant the ultraviolet radiating intensity, without being influenced by changes in the tube temperature of the lamp.

In the conventional thermal printer according to the color direct recording, there is disposed a sensor for detecting temperature, a lamp cooling fan and a heat discharging device, all near each lamp in order to control the radiating intensity of the lamp. Those devices as well as the above reflector are assembled via separately associated mounting members. The arrangement associated with the lamp for good fixation is involved in a problem of structural complication. A plurality of sensors must be associated individually with the lamps, so as to increase the cost of manufacture.

Another problem lies in that air is sent directly to the illuminating face of the lamp by the cooling fan. A limited portion receiving the cooling air is cooled to be the coolest portion among the portions on the lamp tube. Also, because mercury is enclosed in the tube, excessive cooling of the lamp deposits the mercury inside the tube at the coolest portion until the discharge of the ultraviolet radiation is hindered. Thereby, the radiating intensity will be lowered.

SUMMARY OF THE INVENTION

In view of the foregoing problems, an object of the present invention is to provide a lamp temperature control device which can be simply constructed with little cost.

Another object of the present invention is to provide a color direct thermal printer capable of keeping the tube temperature of the ultraviolet lamp regulated and performing stable fixation of the coloring material.

In order to achieve the above and other objects and advantages of this invention, a reflector is disposed in such a manner that a tubular lamp contacts the reflector partially. Air is sent to the reflector so as to cool the lamp via the reflector. On the reflector is mounted a temperature sensor for detecting the temperature. In accordance with the measured temperature at the sensor, a fan is driven if the measured temperature is high, and is stopped if the measured temperature is low.

In a preferred embodiment, the sensor is mounted on an outer wall of the reflector and in a position where the reflector contacts the tubular lamp. Two tubular lamps are used with an advantage. The reflector is disposed to contact both tubular lamps. The sensor is disposed between the two tubular lamps. When the measured temperature at the sensor is greater than a first temperature, the fan is driven. When the measured temperature is less than or equal to the first temperature, then the fan is stopped from operation. When the measured temperature at the sensor is less than a second temperature lower than the first temperature, then at least one of the two tubular lamps is actuated for a predetermined period.

In the present invention, the reflector is used also as a heat-discharging plate, so that the number of parts can be reduced advantageously. It is possible to facilitate the mounting and handling of the parts. The cost for manufacturing the articles can be lowered. The ultraviolet lamp and the reflector are arranged so as to be in contact. The cooling fan is actuated in accordance with a surface temperature of the reflector. It is possible to keep the tube temperature of the lamp stable so as to perform fixation of the coloring in a uniform manner. Further, if the surface temperature of the reflector is greater than the first temperature, then the fan is actuated to cool the tube of the lamp. If the surface temperature of the reflector is less than the second temperature, then the lamp is actuated to raise the tube temperature. It is possible to keep the tube temperature of the lamp in the range between the first and second temperatures. Therefore, a sufficient amount of ultraviolet radiation required for fixation of the coloring can be obtained unfailingly, so as to stabilize the fixation. The cooling fan is disposed to direct the lamp cooling air to an end of the lamp. It is possible to avoid depositing mercury in the middle of the lamp tube facing on the recording material. The emanated ultraviolet radiation can be applied to the recording material without being hindered by the fan.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
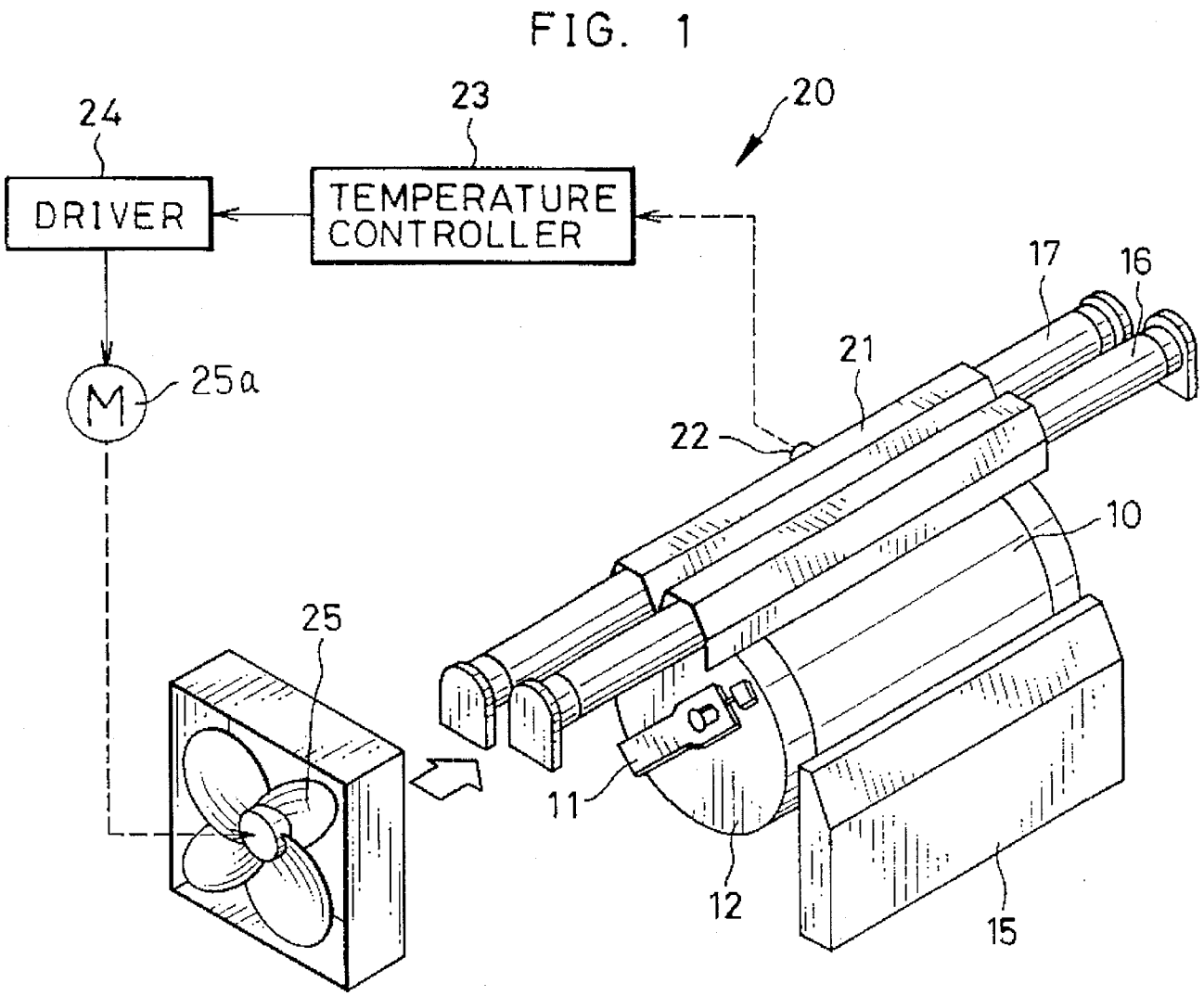
FIG. 1 is a schematic view illustrating a color direct thermal printer incorporating a lamp temperature control device in accordance with an embodiment of the present invention.
Figure 2:
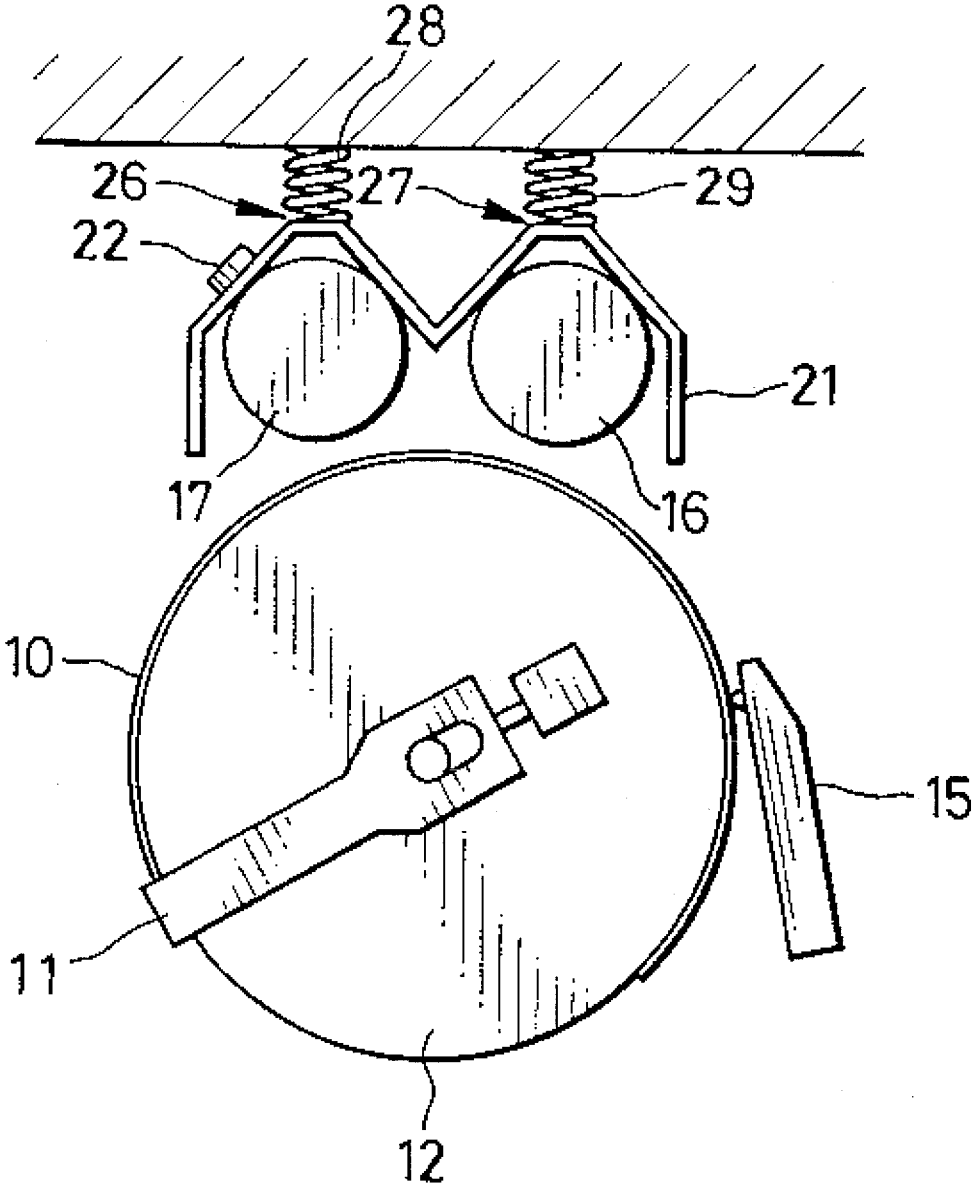
FIG. 2 is a side elevation illustrating an important part of the thermal printer of FIG. 1.

In FIGS. 1 and 2 illustrating a novel printer according to the color direct thermal printing for an embodiment of the present invention, a color thermosensitive recording material 10 of a sheet shape is fixedly mounted on a platen drum 12 while a leading end of the color thermosensitive recording material 10 is retained by a clamp member 11. During a printing operation inclusive of thermal recording and fixation, the platen drum 12 is rotated at a stable speed by a motor (not shown).

Figure 7:
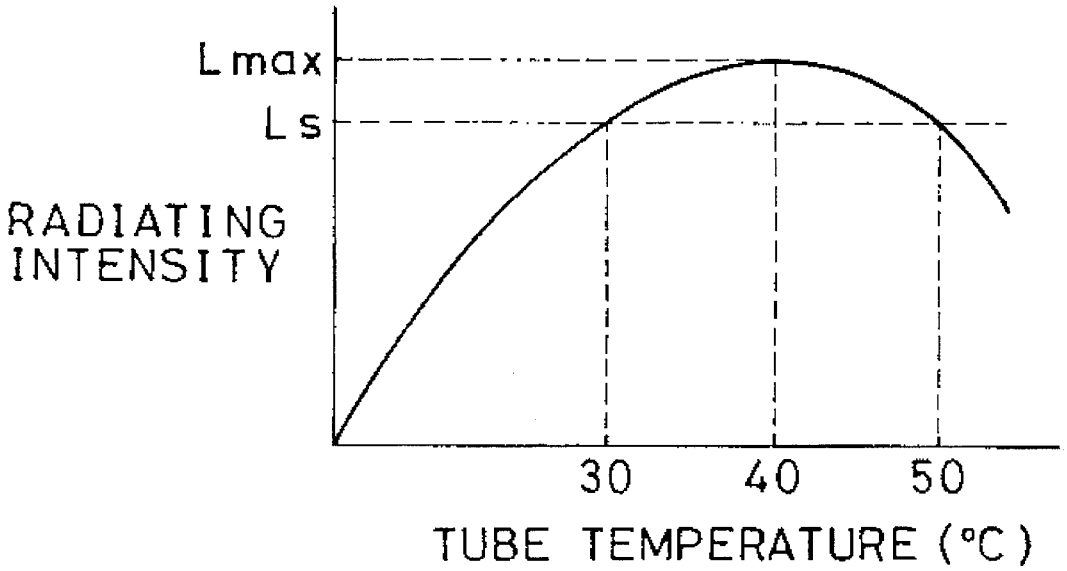
FIG. 7 is a graph illustrating a relationship between the tube temperature of the lamps and radiating intensity thereof.
Figure 8:
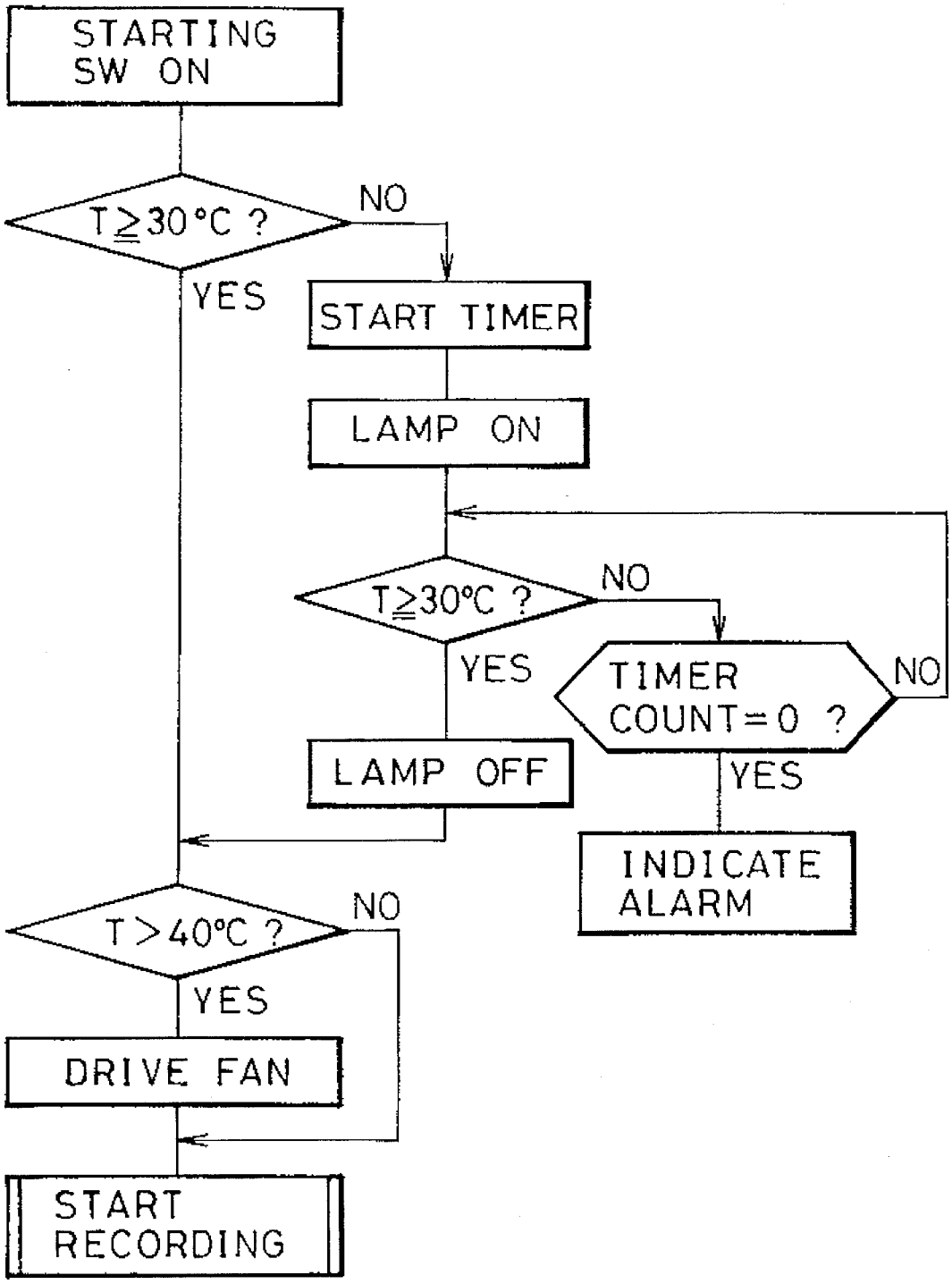
FIG. 8 is a flow chart illustrating a sequence of standing by for the recording in the thermal printer in FIG. 5.

Near the periphery of the platen drum 12 are arranged a thermal head 15 and tubular ultraviolet lamps 16 and 17. The thermal head 15 is in a position for thermal recording. The tubular ultraviolet lamps 16 and 17 lie downstream from the thermal head 15. The thermal head 15 is constituted of a great number of linearly arranged heating elements, and emit heat energy adapted to a characteristic of each color and coloring density for the color. The tubular ultraviolet lamp 16 associated with the yellow color emanates ultraviolet radiation peaking at a wavelength of approximately 420 nm. The tubular ultraviolet lamp 17 associated with the magenta color emanates ultraviolet radiation peaking at a wavelength of approximately 365 nm. Both tubular ultraviolet lamps 16 and 17 are longer than the platen drum 12 so that the printer can utilize the lamp middle portions which have a large intensity of radiation and high stability. The tubular ultraviolet lamps 16 and 17 have a radiating intensity which changes according to the tube temperature, as is known in the art. The radiating intensity comes up to the maximum Lmax when the tube temperature is 40° C., as illustrated in FIG. 7.

A lamp temperature control device 20 is constituted of a reflector 21, a temperature sensor 22, a temperature control circuit 23, a motor driver 24, a motor 25*a*, and a cooling fan 25. The reflector 21 is W-shaped to have two bends 26 and 27, where respective springs 28 and 29 are secured. The springs 28 and 29 press the reflector 21 against the rear of the tubular ultraviolet lamps 16 and 17. In other words, the inside of the bend 26 is in contact with the tubular ultraviolet lamp 17. The inside of the bend 27 is in contact with the tubular ultraviolet lamp 16. The reflector 21 has such a length that the width of a color thermosensitive recording area of the recording material 10 is coverable. Therefore the middle portions of the tubular ultraviolet lamps 16 and 17 are covered by the reflector 21. The reflector 21 is formed of material having high heat conductivity, such as aluminum.

The outside of the reflector 21 is provided with the temperature sensor 22 for measuring the surface temperature of the reflector 21. The temperature sensor 22, for example, consists of a thermistor wherein the resistance thereof changes with temperature. A signal representing the temperature as measured by the temperature sensor 22 is sent into the temperature control circuit 23, and compared with a reference temperature, preset at 40° C. for example. If the measured temperature according to the measured temperature signal is greater than the reference temperature, then the temperature control circuit 23 sends a "High" signal into the motor driver 24. If the measured temperature according to the measured temperature signal is less than or equal to the reference temperature, then the temperature control circuit 23 sends a "Low" signal into the motor driver 24. The motor driver 24, when receiving the High signal, drives the motor 25*a* and the cooling fan 25 beside the reflector 21. The motor driver 24, when receiving the Low signal, stops the cooling fan 25. The temperature sensor 22 preferably can be disposed in the position of contact between the reflector 21 and either of the tubular ultraviolet lamps 16 and 17. In the longitudinal direction of the tubular ultraviolet lamps 16 and 17, the temperature sensor 22 is preferably disposed in the center. The cooling fan 25 is disposed in association with one end of the tubular ultraviolet lamps 16 and 17, and sends air to the tubular ultraviolet lamps 16 and 17 in the axial direction. Therefore, the tube temperature is the lowest in the end portion of the tubular ultraviolet lamps 16 and 17. The end portions of the tubular ultraviolet lamps 16 and 17 are not in use for the fixation of the coloring. No matter how much mercury may be deposited by the cooling air, efficiency in the fixation is kept from falling because only the middle portions of the tubular ultraviolet lamps 16 and 17 are used for the fixation.

Figure 3:
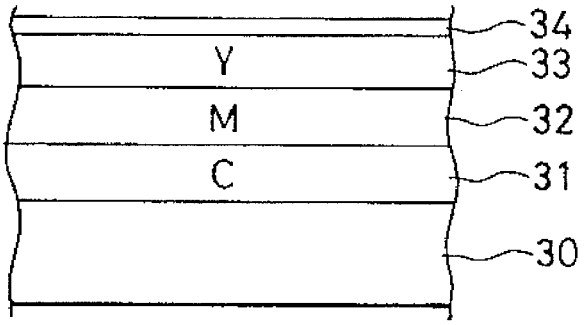
FIG. 3 is an explanatory view illustrating a layered structure of a color thermosensitive recording material.

FIG. 3 illustrates the color thermosensitive recording material 10, in which a support 30 is provided with a cyan coloring layer 31, a magenta coloring layer 32, a yellow coloring layer 33, and a protective layer 34, formed in the layered structure in the order listed. The thermal recording is performed in the order of stepped access, namely from the obverse side, the yellow coloring layer 33 toward cyan coloring layer 31 at the reverse side. Alternatively, the recording material to be used may have a different order between layers, e.g. yellow as a middle coloring layer and magenta as the coloring layer at the obverse side. The order of thermal recording may follow the order of magenta, yellow and then cyan. Note that there are formed intermediate layers (not shown) between the layers 31 to 34 of the recording material 10.

The cyan coloring layer 31 includes as its main components an electron-donor type dye precursor and an electron-acceptor type compound, and forms a cyan dye when heated.

The magenta coloring layer 32 includes a diazonium salt compound having a maximum absorption wavelength of approximately 365 nm, and a coupler which forms a magenta dye when it is thermally reacted with the diazonium salt compound. When ultraviolet radiation of about 365 nm is applied to the magenta coloring layer 32 after thermal recording, the diazonium salt compound is decomposed photochemically and loses its coloring ability. The yellow coloring layer 33 includes a diazonium salt compound having a maximum absorption wavelength of approximately 420 nm, and a coupler which forms a yellow dye when it is thermally reacted with the diazonium salt compound. When near ultraviolet radiation of about 420 nm is applied to the yellow coloring layer 33, layer 33 is decomposed photochemically and loses its coloring capacity.

Figure 4:
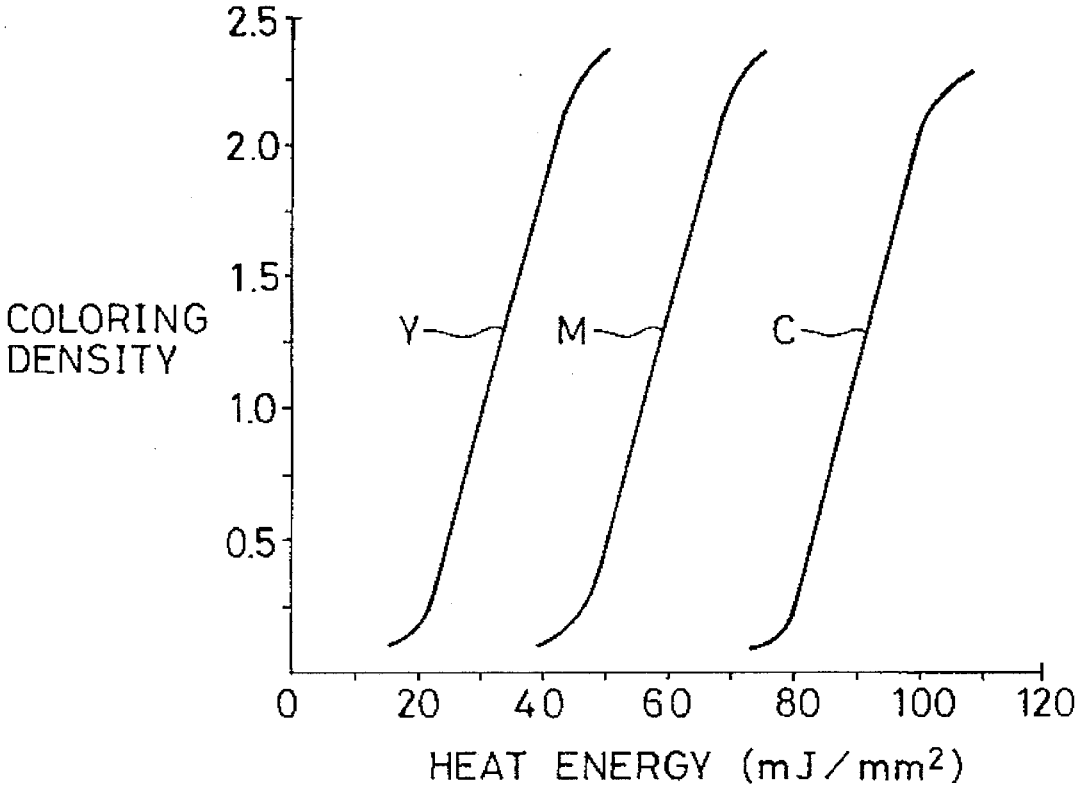
FIG. 4 is a graph illustrating coloring characteristics of the recording material.

FIG. 4 illustrates coloring characteristics of the coloring layers 31 to 33. The horizontal coordinate axis is taken to express the heat energy generated by the heating elements of the thermal head 15. In the color thermosensitive recording material 10, the coloring of the yellow coloring layer 33 requires a lowest heat energy. The coloring of the cyan coloring layer 31 requires a highest heat energy.

The operation of the above embodiment is described now. The thermal printer is first energized. The temperature sensor 22 starts operating, and measures the tube temperature of the tubular ultraviolet lamps 16 and 17 through the reflector 21. The measured temperature signal is sent into the temperature control circuit 23, which compares the measured temperature signal with the reference temperature.

If the measured temperature according to the signal from the temperature sensor 22 is greater than the reference temperature, then the temperature control circuit 23 sends the High signal into the motor driver 24. The motor driver 24, if the cooling fan 25 is not moving, drives the cooling fan 25, which sends air onto the reflector 21 and the tubular ultraviolet lamps 16 and 17. The contact of the reflector 21 with the tubular ultraviolet lamps 16 and 17 is an advantage in good efficiency in cooling the tubular ultraviolet lamps 16 and 17. When the temperature of the tubular ultraviolet lamps 16 and 17 falls to a predetermined temperature, then the cooling fan 25 is stopped.

If the measured temperature according to the signal from the temperature sensor 22 is less than or equal to the reference temperature, then the temperature control circuit 23 sends the Low signal into the motor driver 24. The cooling fan 25 stands stopped, which prevents the heat in the reflector 21 from being further discharged than in a natural manner. The tube temperature of the tubular ultraviolet lamps 16 and 17 while in contact with the reflector 21 is left as is after being raised, and thus free from forced cooling.

A printing operation is externally commanded. The color thermosensitive recording material 10 is supplied from a cassette (not shown) and is set in a clamping position on the platen drum 12. The clamp member 11 presses the color thermosensitive recording material 10 fixedly on the platen drum 12. Subsequently, the platen drum 12 is rotated in response to rotation of the motor (not shown), so as to wind the color thermosensitive recording material 10 on the periphery of the platen drum 12. The color thermosensitive recording material 10 starts being fed at the same time as the yellow fixing lamp 16 is actuated for radiation.

The platen drum 12 rotates until an advancing edge of the color thermosensitive recording material 10 reaches the thermal head 15, which thermally records a yellow image on the yellow coloring layer 33 line-after-line. In the thermal recording of the yellow image, each heating element of the thermal head 15 generates heat energy determined in consideration of the coloring characteristics in FIG. 4. A portion where the yellow image is recorded comes under the yellow fixing lamp 16, so as to start fixation of the yellow image. As the yellow fixing lamp 16 emanates ultraviolet radiation of approximately 420 nm, the diazonium salt compound in the yellow coloring layer 33 is photochemically decomposed to invalidate its coloring ability. When a trailing end of the color thermosensitive recording material 10 is passed off from the yellow fixing lamp 16, the radiation from the yellow fixing lamp 16 is stopped.

During the fixation with the yellow fixing lamp 16, the temperature control circuit 23 is monitoring the lamp temperature. When the lamp temperature is raised, the temperature control circuit 23 drives the cooling fan 25 so as to keep the tube temperature of the yellow fixing lamp 16 from changing. The yellow fixing lamp 16 emanates ultraviolet radiation at the unchanged intensity. The rear of the yellow fixing lamp 16 is covered by the reflector 21 which is open toward the front, so that the radiation emanated to the rear is reflected on the reflector 21 to the front, and is applied to the color thermosensitive recording material 10.

In the course of rotation of the platen drum 12, the advancing edge of the color thermosensitive recording area on the recording material 10 comes to the thermal head 15 for the second time. The thermal head 15 thermally records a magenta image on the magenta coloring layer 32 line-after-line. In the recording of the magenta image, each heating element of the thermal head 15 generates energy determined in consideration of the characteristics in FIG. 4. The magenta fixing lamp 17 emanates ultraviolet radiation of approximately 365 nm. During the fixation, the temperature of the magenta fixing lamp 17 is monitored and controlled while in contact with the reflector 21. The magenta fixing lamp 17 emanates ultraviolet radiation at the unchanged intensity. After the magenta image is thermally recorded on the recording material 10, the ultraviolet radiation is applied to the color thermosensitive recording material 10 by the magenta fixing lamp 17. The diazonium salt compound in the magenta coloring layer 32 is photochemically decomposed to invalidate the magenta coloring ability in the entirety of the color thermosensitive recording material 10. When the trailing end of the color thermosensitive recording material 10 is passed off from the magenta fixing lamp 17, the radiation from the magenta fixing lamp 17 is stopped.

The platen drum 12 rotates until the advancing edge of the color thermosensitive recording material 10 reaches the thermal head 15, which thermally records a cyan image on the cyan coloring layer 31 line-after-line. The coloring of the cyan coloring layer 31 requires high coloring heat energy of at least as much as 80 $mJ/mm^2$, which does not allow color to develop in an ordinary condition of preserving the color thermosensitive recording material 10. The cyan coloring layer 31 lacks a characteristic of photochemical fixability, so that fixation is not effected during the thermal recording for the cyan coloring layer 31.

The thermal recording of the yellow, magenta and cyan images is finished. The clamp member 11 is unlatched. The color thermosensitive recording material 10 after the thermal printing is discharged to a receptacle tray (not shown).

Figure 5:
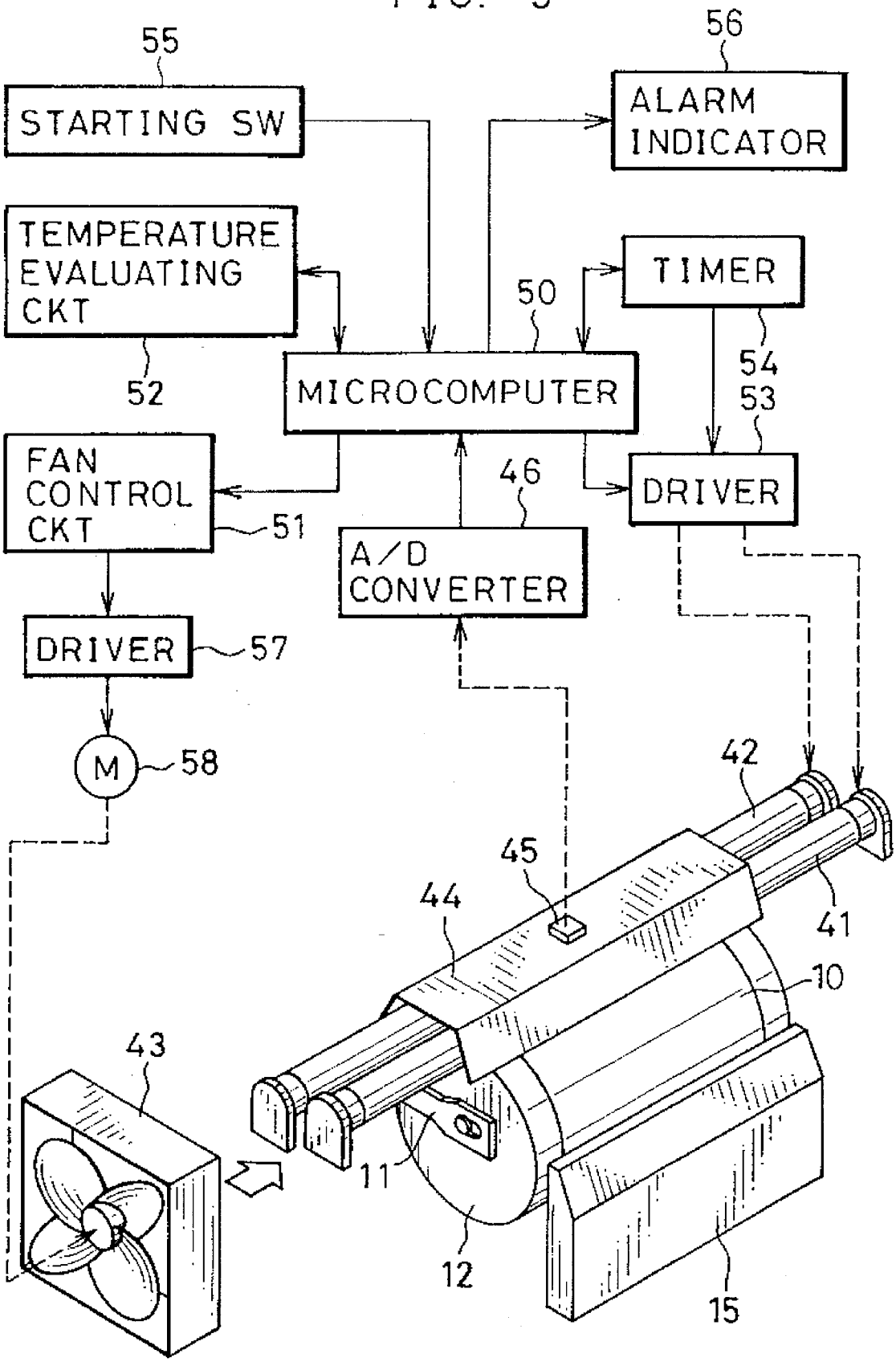
FIG. 5 is a schematic view illustrating another preferred embodiment of the present invention for a color direct thermal printer.

Referring to FIGS. 5 to 9, another preferred embodiment of the present invention will now be described. Elements similar to the former embodiment of FIG. 1 are referred to with identical reference numerals in those drawings. In FIG. 5, on the periphery of the platen drum 12 are arranged tubular ultraviolet lamps 41 and 42, respectively, for yellow and magenta fixation. A cooling fan 43 is disposed in association with one end of the lamps 41 and 42. As illustrated in FIG. 7, those tubular ultraviolet lamps 41 and 42 have a characteristic in which the radiating intensity comes up to the maximum intensity Lmax when the tube temperature is 40° C., and comes to a standard radiating intensity Ls required for fixation when the tube temperature is 30° C. or 50° C.

A reflector 44 is shaped like a channel. The outside of the reflector 44 is provided with a temperature sensor 45 for measuring the surface temperature of the reflector 44. Note that the reflector 44 can be W-shaped to have two bends, in a manner similar to the former reflector 21 in FIG. 2.

Figure 6:
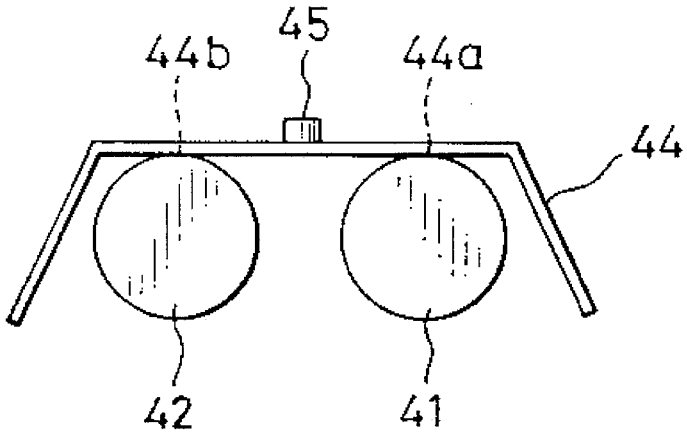
FIG. 6 is a side elevation illustrating a relationship between ultraviolet lamps and a reflector illustrated in FIG. 5.

As is illustrated in FIG. 6, each lamp tube of the tubular ultraviolet lamps 41 and 42 is in contact with the inside of the reflector 44, respectively, in positions 44*a* and 44*b*. The temperature sensor 45 is disposed in the middle between the contact positions 44*a* and 44*b*. A measured temperature signal at the temperature sensor 45 in an analog form is converted into a digital signal by an A/D converter 46, and then sent to a microcomputer 50 as temperature data.

The microcomputer 50 is connected to a fan control circuit 51, a temperature evaluating circuit 52, a lamp driver 53, a timer 54, a starting switch 55, and an alarm indicator 56. The fan control circuit 51 compares the temperature data with a preset reference temperature limit. If the temperature according to the temperature data is greater than the limit reference temperature, then the fan control circuit 51 sends a drive signal into a motor driver 57, and drives the cooling fan 43 via a fan motor 58. If the temperature according to the temperature data is less than or equal to the limit reference temperature, then the fan control circuit 51 sends a stop signal to the motor driver 57, and stops the cooling fan 43. Note that the limit reference temperature is predetermined to be 40° C., at which the ultraviolet radiation can be obtained at the maximum intensity Lmax.

Actuation of the starting switch 55 causes a printing command signal to be entered into the microcomputer 50, upon which the temperature evaluating circuit 52 is actuated. The temperature evaluating circuit 52 compares the temperature data with an initial reference temperature preset for starting the recording. If the temperature according to the temperature data is greater than or equal to the initial reference temperature, then the temperature evaluating circuit 52 sends a "High" signal into the microcomputer 50. If the temperature according to the temperature data is below the initial reference temperature, then the temperature evaluating circuit 52 sends a "Low" signal into the microcomputer 50. Note that the initial reference temperature is predetermined to be 30° C., at which the ultraviolet radiation can be obtained at the standard radiating intensity Ls, namely, the minimum sufficient temperature for the fixation of the coloring.

While the timer 54 measures a predetermined period of time, the lamp driver 53 supplies the tubular ultraviolet lamps 41 and 42 with power so as to actuate the tubular ultraviolet lamps 41 and 42. The alarm indicator 56 is caused by the microcomputer 50 to indicate alarming information when either of the tubular ultraviolet lamps 41 and 42 is involved in an accidental operation. Note that those functions of the thermal printer above are all processed within the microcomputer 50 by use of software.

Upon turning on a power switch of the thermal printer of the present embodiment, the temperature sensor 45 starts operating. The temperature sensor 45 indirectly measures the tube temperature of both tubular ultraviolet lamps 41 and 42, as the temperature sensor 45 is mounted on the reflector 44 in contact with the tubular ultraviolet lamps 41 and 42.

The measured temperature signal from the temperature sensor 45 is converted by the A/D converter 46 into the temperature data, which is sent into the fan control circuit 51 through the microcomputer 50. If the temperature according to the temperature data is over the limit reference temperature 40° C., then the fan control circuit 51 sends the drive signal into the motor driver 57, so as to drive the cooling fan 43 via the fan drive motor 58. The cooling fan 43 then sends air on to the tubular ultraviolet lamps 41 and 42. With the cooling fan 43 located beside the tubular ultraviolet lamps 41 and 42, the cooling air is applied along the tubular surface of the tubular ultraviolet lamps 41 and 42 to the entirety thereof, so as to cool the tubular ultraviolet lamps 41 and 42 with great efficiency. The air lowers the tube temperature of the tubular ultraviolet lamps 41 and 42 down to 40° C. Upon the tube temperature reaching 40° C., the fan 43 is stopped.

On the other hand, if the temperature according to the temperature data is less than or equal to 40° C., then the cooling fan control circuit 51 sends the stop signal into the motor driver 57, so as to leave the cooling fan 43 inactive. Stopping of the cooling fan 43 prevents the heat in the reflector 44 from being further discharged than in a natural manner. The tube temperature of the tubular ultraviolet lamps 41 and 42 on the reflector 44 is left as is after being raised, and thus is free from forced cooling.

With the power supplied for the thermal printer, the starting switch 55 is operated. An operation of standing by for recording is performed following the flow depicted in FIG. 8. At first the microcomputer 50 actuates the temperature evaluating circuit 52, which compares the temperature data with an initial reference temperature 30° C. If the temperature according to the temperature data is greater than or equal to 30° C., then the High signal is sent to the microcomputer 50. Upon the High signal, the microcomputer 50 starts the printer recording.

If the temperature according to the temperature data is less than 30° C., then the Low signal is sent to the microcomputer 50. Upon receipt of the Low signal, the microcomputer 50 actuates the timer 54 to start measurement of the predetermined period, and actuates the lamp driver 53 to turn on the tubular ultraviolet lamps 41 and 42. The signal output from the temperature evaluating circuit 52 as High or Low is checked successively. If the output signal changes from Low to High, then the tubular ultraviolet lamps 41 and 42 are turned off temporarily, before starting the recording operation. If the signal output from the temperature evaluating circuit 52 remains Low, then it is judged that the radiating intensity of the tubular ultraviolet lamps 41 and 42 is insufficient for fixation. The alarm information is indicated by the alarm indicator 56, while the microcomputer 50 inhibits the routine from staring the recording. Therefore, the tube temperature of the tubular ultraviolet lamps 41 and 42, during the stand-by period, is adjusted to be between 30° C. and 40° C., because the fan 43 is controlled by the cooling fan control circuit 51 even while the printer is still on standby. Note that it is also possible instead of the above operation to supply electrodes of the tubular ultraviolet lamps 41 and 42 with currents so as to preheat the tubular ultraviolet lamps 41 and 42, without actuation of the tubular ultraviolet lamps 41 and 42.

The operation of standing-by for the recording causes the tube temperature of the tubular ultraviolet lamps 41 and 42 to come to 30° C. Then the recording operation is started.

The color thermosensitive recording material 10 is supplied from a cassette (not shown), before the thermal recording of the yellow, magenta and cyan images is performed, in the manner the same as the former.

Figure 9:
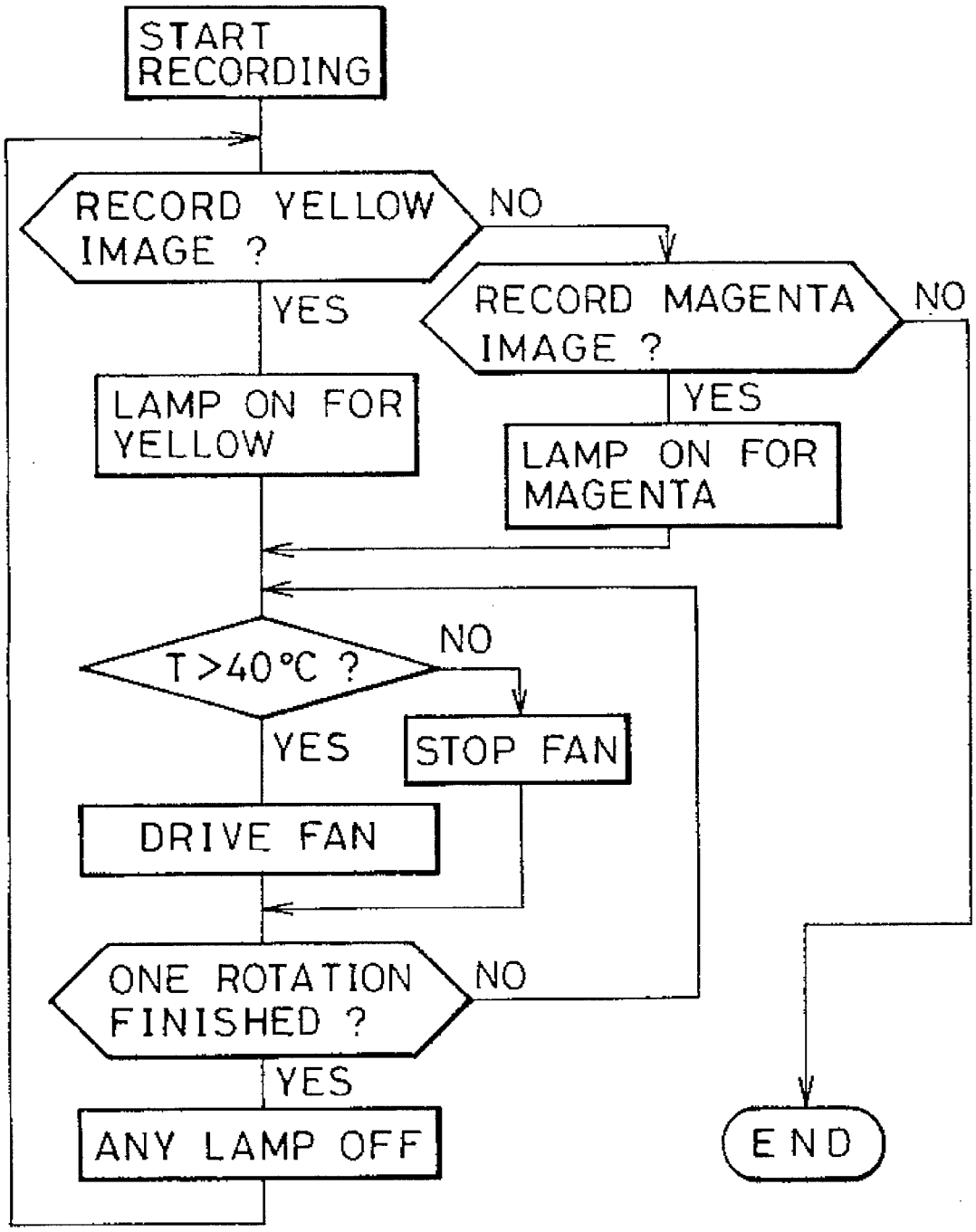
FIG. 9 is a flow chart illustrating a sequence of adjusting the tube temperature during the recording in the thermal printer in FIG. 5.

During the recording operation, the tube temperature of the tubular ultraviolet lamps 41 and 42 is controlled in accordance with the flow depicted in FIG. 9. In recording the yellow image, the yellow fixing lamp 41 is actuated. In recording the magenta image, the magenta fixing lamp 42 is actuated. Each tube temperature of the tubular ultraviolet lamps 41 and 42 is indirectly measured by the temperature sensor 45, and entered into the cooling fan control circuit 51. If the temperature according to the temperature data is over 40° C., then the drive signal is sent and drives the cooling fan 43. If the temperature according to the temperature data is less than or equal to 40° C., then the stop signal is sent and leaves the cooling fan 43 inactive. The tube temperature of the tubular ultraviolet lamps 41 and 42 is regulated to be near 40° C. Therefore the ultraviolet radiating intensity applied to the color thermosensitive recording material 10 can be kept sufficiently larger than the standard radiating intensity Ls.

Figure 10:
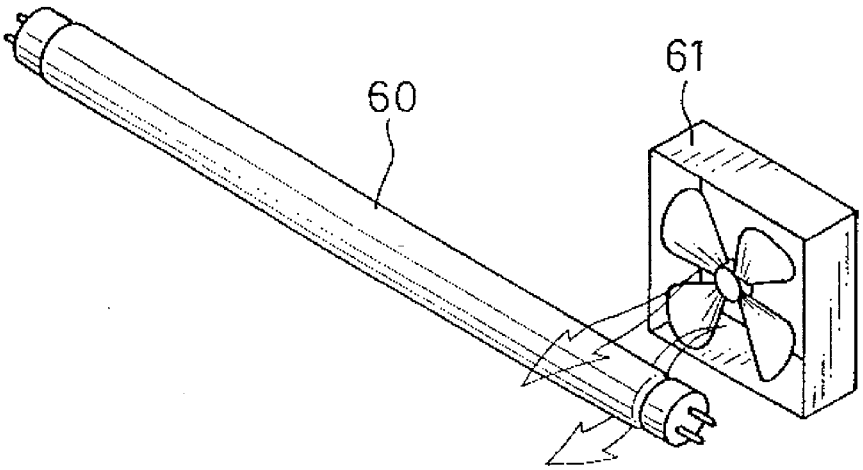
FIG. 10 is an explanatory view illustrating another preferred arrangement of a cooling fan.
Figure 11:
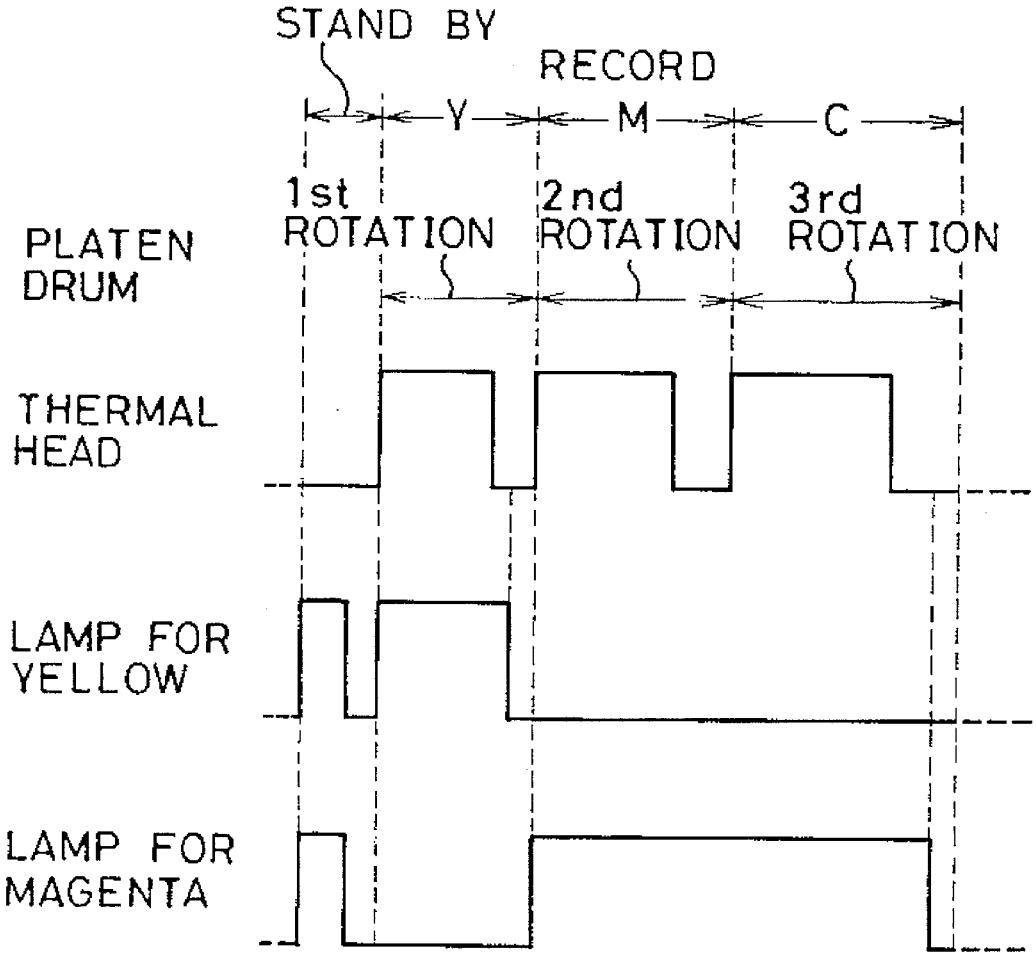
FIG. 11 is a timing chart illustrating a relationship between the thermal recording of each coloring layers and routines of actuating the ultraviolet lamps.

In the above embodiment, the cooling air is applied to the entire tube surfaces of the lamps by the arrangement of the fan associated with the tube end. Alternatively, the cooling air may be applied to only a part of the tube surfaces, in view of the purpose for adjusting the radiating intensity. Further, it is also preferable to dispose a cooling fan 61 face-to-face with the tube of an ultraviolet lamp 60 and near one end of the ultraviolet lamp 60, as illustrated in FIG. 10. Although some mercury may be deposited in the end portion of the ultraviolet lamp 60 in the manner similar to the former fans, efficiency in the fixation is kept from falling because only the middle portion of the ultraviolet lamp 60 is used for the fixation.

In the above embodiments, the tubular ultraviolet lamps 16, 17, 41, 42 are actuated only during the printing of the yellow and magenta images. Alternatively, it is preferable to actuate the magenta fixing lamp 17, 42 during the printing of the cyan image as well as during the printing of the magenta image. This is effective in supplying the color thermosensitive recording material 10 with a sufficiently great amount of ultraviolet radiation for fixation, and additionally in bleaching the color thermosensitive recording material 10.

In the above embodiments, both of the two combined lamps 16, 17, or 41, 42 are actuated for raising the tube temperature. Alternatively, it is also preferable to actuate only one of two combined lamps for the purpose of preheating both of the combined lamps.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

During the recording operation, the tube temperature of the lamps 41 and 42 is controlled in accordance with the flow depicted in FIG. 9. In recording the yellow image, the yellow fixing lamp 41 is actuated. In recording the magenta image, the magenta fixing lamp 42 is actuated. Each tube temperature of the lamps 41 and 42 is indirectly measured by the sensor 45, and entered into the fan control circuit 51. If the temperature according to the temperature data is over 40° C., then the drive signal is sent and drives the fan 43. If the temperature according to the temperature data is below or equal to 40° C., then the stop signal is sent and leaves the fan 43 inactive. The tube temperature of the lamps 41 and 42 is regulated to be near 40° C. Therefore the ultraviolet radiating intensity applied to the recording material 10 can be kept sufficiently larger than the standard radiating intensity Ls.

In the above embodiment, the cooling air is applied to the entire tube surfaces of the lamps by the arrangement of the fan associated with the tube end. Alternatively, the cooling air may be applied to only a part of the tube surfaces, in view of the purpose for adjusting the radiating intensity. Further, it is also preferable to dispose a cooling fan 61 face to face with the tube of an ultraviolet lamp 60 and near one end of the lamp 60, as illustrated in FIG. 10. Although some mercury may be deposited in the end portion of the lamp 60 in the manner similar to the former fans, efficiency in the fixation is kept from falling because only the middle portion of the lamp 60 is used for the fixation.

In the above embodiments, the ultraviolet lamps 16, 17, 41, 42 are actuated only during the printing of the yellow and magenta images. Alternatively, it is preferable to actuate the magenta fixing lamp 17, 42 during the printing of the cyan image as well as during the printing of the magenta image. This is effective in supplying the recording material 10 with a sufficiently great amount of ultraviolet radiation for fixation, and additionally in bleaching the recording material 10.

In the above embodiments, both of the two combined lamps 16, 17, or 41, 42 are actuated for raising the tube temperature. Alternatively, it is also preferable to actuate only one of two combined lamps for the purpose of preheating both of the combined lamps.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A lamp temperature control device comprising:

at least one lamp having a longitudinal axis;

a reflector disposed behind said at least one lamp for reflecting to a forward direction electromagnetic radiation emanated in a rearward direction from said at least one lamp, a portion of said reflector contacting said at least one lamp to receive heat from said at least one lamp;

a cooling fan for forcing air onto said reflector;

a temperature sensor mounted on said reflector for measuring temperature of said at least one lamp indirectly via said reflector; and control means for driving said cooling fan when said measured temperature is greater than a first temperature and for stopping said cooling fan when said measured temperature is less than or equal to said first temperature.

2. The lamp temperature control device as defined in claim 1, wherein said at least one lamp is forcibly actuated at least for a predetermined period, when a measured temperature during extinction of at least one lamp is equal to or less than a second temperature lower than said first temperature.

3. The lamp temperature control device as defined in claim 1, wherein said cooling fan is disposed so as to force air in a longitudinal direction of said at least one lamp.

4. The lamp temperature control device as defined in claim 1, wherein said cooling fan is disposed so as to force air onto a first end of said at least one lamp.

5. The lamp temperature control device as defined in claim 1, wherein said temperature sensor is mounted on an outside surface of said reflector.

6. The lamp temperature control device as defined in claim 5, wherein said temperature sensor is mounted on a middle portion of said reflector.

7. The lamp temperature control device as defined in claim 5, wherein said at least one lamp comprises first and second ultraviolet lamps arranged in parallel for respectively emanating ultraviolet radiation of different first and second wavelength ranges.

8. The lamp temperature control device as defined in claim 7, wherein said reflector is pressed against said first and second ultraviolet lamps by spring members.

9. The lamp temperature control device as defined in claim 7, wherein said reflector is W-shaped and each of said first and second ultraviolet lamps has at least two portions in contact with said reflector.

10. The lamp temperature control device as defined in claim 7, wherein said reflector is channel-shaped and each of said first and second ultraviolet lamps has a single rear portion in contact with said reflector.

11. The lamp temperature control device as defined in claim 7, wherein the lamp temperature control device is disposed in a color direct thermal printer for printing a full-color image on color thermosensitive recording material having first, second and third thermosensitive coloring layers formed sequentially from an obverse layer side toward a reverse layer side with each of said first, second and third thermosensitive coloring layers being developed in a different color, said color direct thermal printer having a thermal head which is moveable relative to said color thermosensitive recording material for thermally recording with said first, second and third thermosensitive coloring layers, thermal recording with said first thermosensitive coloring layer being followed by actuation of said first ultraviolet lamp for fixation of said first thermosensitive coloring layer and thermal recording with said second thermosensitive coloring layer being followed by actuation of said second ultraviolet lamp for fixation of said second thermosensitive coloring layer.

12. A color direct thermal printer for printing a full-color image on color thermosensitive recording material having first, second and third thermosensitive coloring layers which are colored selectively in accordance with heat energy applied by a thermal head, said first, second and third thermosensitive coloring layers being developed in different colors and formed sequentially from an obverse layer side toward a reverse layer side, the color direct thermal printer comprising:

a first ultraviolet lamp mounted along a first longitudinal axis for emanating ultraviolet radiation of a first wavelength range so as to fix said first thermosensitive coloring layer with said ultraviolet radiation of said first wavelength range during movement of said color thermosensitive recording material in a direction perpendicular to said first longitudinal axis, after thermal recording of said first thermosensitive coloring layer by said thermal head;

a second ultraviolet lamp mounted along a second longitudinal axis which is parallel with said first longitudinal axis, for emanating ultraviolet radiation of a second wavelength range different from said first wavelength range, so as to fix said second thermosensitive coloring layer with said ultraviolet radiation of said second wavelength range, during movement of said color thermosensitive recording material in the perpendicular direction with respect to said second longitudinal axis, after thermal recording of said second thermosensitive coloring layer by said thermal head;

a reflector disposed behind said first and second ultraviolet lamps for reflecting to a forward direction ultraviolet radiation emanated along a rearward direction from said first and second ultraviolet lamps, said reflector contacting said first and second ultraviolet lamps along respective portions to receive heat from said first and second ultraviolet lamps;

a cooling fan for forcing air onto said reflector;

a temperature sensor mounted on said reflector for measuring temperature of said first and second ultraviolet lamps indirectly via said reflector;

fan control means for driving said cooling fan when a measured temperature is greater than a first temperature, and for stopping said cooling fan when a measured temperature is less than or equal to said firs temperature; and lamp heating means for actuating at least one of said first and second ultraviolet lamps for a predetermined period, when a measured temperature during extinction of said first and second ultraviolet lamps is less than a second temperature which is lower than said first temperature, so as to raise the temperature of said first and second ultraviolet lamps.

13. The color direct thermal printer as defined in claim 12, further comprising a starting key for starting a printing operation, wherein said lamp heating means is operated before said printing operation if said measured temperature upon operating said starting key is less than said second temperature.

14. The color direct thermal printer as defined in claim 13, wherein said first thermosensitive coloring layer is a yellow coloring layer, said second thermosensitive coloring layer is a magenta coloring layer, and said third thermosensitive coloring layer is a cyan coloring layer.

15. The color direct thermal printer as defined in claim 14, wherein said temperature sensor is mounted on an exterior surface of said reflector and between said portions respectively contacting said first and second ultraviolet lamps.

16. The color direct thermal printer as defined in claim 15, wherein said first and second ultraviolet lamps have a length longer than a width of said color thermosensitive recording material, and said reflector has a length longer than the width of said color thermosensitive recording material.

17. The color direct thermal printer as defined in claim 16, wherein said cooling fan is disposed so as to force air onto an end of said first and second ultraviolet lamps.

18. A method for controlling the temperature of a lamp when printing a full-color image on color thermosensitive recording material, comprising the steps of:

(a) emanating electromagnetic radiation from at least one lamp provided along a longitudinal axis;

(b) reflecting electromagnetic radiation emanated from said at least one lamp in a rearward direction to a forward direction using a reflector;

(c) directly contacting said at least one lamp to a portion of said reflector to transfer heat away from said at least one lamp via said reflector;

(d) indirectly measuring temperature of said at least one lamp via said reflector with a temperature sensor mounted on said reflector;

(e) forcing air onto said reflector with a cooling fan;

(f) driving said cooling fan when the temperature measured in said step (d) is greater than a first temperature; and (g) stopping said cooling fan when the temperature measured in said step (d) is less than or equal to said first temperature.

19. The method as defined in claim 18, further comprising the step of forcibly actuating said at least one lamp at least for a predetermined period when the temperature measured in said step (d) during extinction of said at least one lamp in said step (g) is equal to or less than a second temperature which is lower than said first temperature.

20. The method as defined in claim 18, wherein said step (a) comprises emanating ultraviolet radiation of different first and second wavelength ranges using first and second ultraviolet lamps arranged in parallel.

* * * * *